US006032012A

United States Patent [19]

Hirono et al.

[11] Patent Number: 6,032,012

[45] Date of Patent: Feb. 29, 2000

[54] DEVELOPING DEVICE, IMAGE FORMING UNIT AND COLOR IMAGE FORMING APPARATUS, BOTH HAVING THE DEVELOPING DEVICE

[75] Inventors: Takeo Hirono, Akishima; Noriki Ono, Higashiyamato; Tatsumi Shimanari, Fussa; Takao Yorifuji, Higashiyamato; Moriyuki Kouroku, Higashimurayama; Yoshiharu Abe, Sumida-ku; Hidefumi Kanai, Koganei; Mitsugu Oishi, Musashimurayama, all of Japan

[73] Assignees: Casio Computer Co., Ltd., Tokyo; Casio Electronics Manufacturing Co., Ltd., Iruma, both of Japan

[21] Appl. No.: 09/181,479

[22] Filed: Oct. 28, 1998

[30] Foreign Application Priority Data

Nov. 5, 1997 [JP] Japan ..... 9-302914

[51] Int. Cl.[7] ..... G03G 15/08

[52] U.S. Cl. ..... 399/252; 399/98; 399/103; 399/264; 399/283; 399/285; 399/286

[58] Field of Search ..... 399/98, 102, 103, 399/106, 252, 258, 260, 262, 264, 111, 113, 119, 281, 283, 284, 285, 286, 43, 53, 55

[56] References Cited

U.S. PATENT DOCUMENTS 4,745,429 5/1988 Mukai et al. ..... 399/283
5,387,963 2/1995 Kajimoto et al. ..... 399/284
5,568,236 10/1996 Toda et al. ..... 399/285
5,587,769 12/1996 Sawada et al. ..... 399/113
5,600,419 2/1997 Sakuraba et al. ..... 399/285
5,708,921 1/1998 Yagi et al. ..... 399/98
5,781,827 7/1998 Shimada et al. ..... 399/55

*Primary Examiner*—Matthew S. Smith
*Attorney, Agent, or Firm*—Frishauf, Holtz, Goodman, Langer & Chick, P.C.

[57] ABSTRACT

A developing device used in an image forming apparatus has a developing roller at a lower opening of a toner hopper, and the developing roller contacts a photosensitive drum to form a developing portion therebetween. The hopper stores non-magnetic toner and is provided with a toner stirring member and a toner feed roller being in press-contact with the developing roller in a lower part of the hopper. A doctor blade contacts a circumferential surface of the developing roller on an upstream side of the developing portion in a rotation direction of the drum. A conductive scooping sheet contacts the circumferential surface of the developing roller on a downstream side of the developing portion. A residual toner not used to develop a latent image on the drum and left on the developing roller is passed under the sheet into the hopper with the rotation of the developing roller. A sheet bias voltage ranging from 0V to −250V is applied to the sheet, so that an attaching force of the residual toner to the developing roller is weakened so that the residual toner can be easily removed by the feed roller.

9 Claims, 7 Drawing Sheets

— CONDITION OF DEVELOPMENT MEMORY —

| AMOUNT OF TRIBOELECTRIC CHARGE OF TONER (μc/g) | SCOOPING SHEET BIAS (V) | | | | | | | |
|---|---|---|---|---|---|---|---|---|
| | 0 | -25 | -50 | -75 | -100 | -150 | -200 | -250 |
| -4.1 | ○ | ○ | ○ | ○ | ○ | ○ | ○ | ○ |
| -5.4 | ○ | ○ | ○ | ○ | ○ | ○ | ○ | ○△ |
| -6.4 | ○ | ○ | ○ | ○ | ○ | ○ | ○△ | × |
| -8.5 | ○ | ○ | ○ | ○ | ○ | ○△ | × | × |
| -10.1 | ○ | ○ | ○ | ○ | ○△ | × | × | × |
| -11.2 | ○ | ○ | ○△ | ○△ | × | × | × | × |
| -13.6 | ○ | △ | × | × | × | × | × | × |

○ : NO APPEARANCE OF DEVELOPMENT MEMORY

○△ : SLIGHT APPEARANCE OF DEVELOPMENT MEMORY (ACCEPTABLE IN PRACTICE)

△ : SUBSTANTIAL APPEARANCE OF DEVELOPMENT MEMORY (UNACCEPTABLE IN PRACTICE)

× : SIGNIFICANT APPEARANCE OF DEVELOPMENT MEMORY (UNACCEPTABLE IN PRACTICE)

FIG.3A

— CONDITION OF IMAGE DEFECT (TONER TRANSPORTATION MALFUNCTION) —

| AMOUNT OF TRIBOELECTRIC CHARGE OF TONER (μc/g) | SCOOPING SHEET BIAS (V) | | | | | | | |
|---|---|---|---|---|---|---|---|---|
| | 0 | -25 | -50 | -75 | -100 | -150 | -200 | -250 |
| -4.1 | × | × | × | × | × | × | ○ | ○ |
| -5.4 | × | × | × | × | × | ○ | ○ | ○ |
| -6.4 | × | × | × | ○ | ○ | ○ | ○ | ○ |
| -8.5 | × | ○ | ○ | ○ | ○ | ○ | ○ | ○ |
| -10.1 | ○ | ○ | ○ | ○ | ○ | ○ | ○ | ○ |
| -11.2 | ○ | ○ | ○ | ○ | ○ | ○ | ○ | ○ |
| -13.6 | ○ | ○ | ○ | ○ | ○ | ○ | ○ | ○ |

○ : APPEARANCE OF IMAGE DEFECT (TONER TRANSPORTATION MALFUNCTION)

× : NO APPEARANCE OF IMAGE DEFECT (TONER TRANSPORTATION MALFUNCTION)

FIG.3B

| COLOR OF TONER (PARTICLE SIZE 8.5μm) | MAGENTA | CYAN | YELLOW | BLACK |
|---|---|---|---|---|
| AMOUNT OF TRIBOELECTRIC CHARGE (μc/g) | 8.5 | 12.0 | 12.5 | 10.1 |

DEVELOPING DEVICE, IMAGE FORMING UNIT AND COLOR IMAGE FORMING APPARATUS, BOTH HAVING THE DEVELOPING DEVICE

BACKGROUND OF THE INVENTION

The present invention relates to a developing device to be installed in an image forming unit such as a printer and a copy machine, and further to an image forming unit having the developing device and a color image forming apparatus in which a plurality of image forming portions having the developing devices, tandemly arranged.

As the image forming apparatus, conventionally known is an electrophotographic image forming apparatus. The image forming apparatus of this type usually has an image forming unit removably installed therein. The image forming unit performs a series of image forming steps: forming an electrostatic latent image on a photosensitive drum, forming (developing) a toner image from the electrostatic latent image, and transporting the toner image to a toner image transfer position at which the toner image is transferred to a paper sheet from the drum.

FIG. 7A shows a vertical cross-sectional view of the image forming unit of this type. FIG. 7B shows an exploded oblique view of a main portion of the developing device installed, as a subunit, in the image forming unit. FIG. 7C shows a partially enlarged vertical cross-sectional view of the developing device in an assembling step. As shown in FIGS. 7A, 7B and 7C, the image forming unit comprises two subunits, namely, a drum subunit 1 and a developing subunit (device) 2.

The drum subunit 1 includes a photosensitive drum 3, a cleaner 4 positioned in a left-side of the drum, a charging roller 5 positioned in an upper left-side of the drum, and a recording head engaging groove 6 immediately above the drum. The cleaner 4 has a toner scooping sheet 7 and a scratching blade 8 both of which are in pressure-contact with the photosensitive drum 3, as well as a waste toner discharge pipe 9. An optical-writing portion of a recording head (not shown), which is fixed on a main body of the image forming apparatus, is inserted in and engaged with the recording head engaging groove 6.

The photosensitive drum 3 includes a grounded conductive metal roller and a photosensitive layer of a photoconducting material which is uniformly coated on a circumferential surface of the metal roller. The photosensitive drum 3 rotates in the clockwise direction as indicated by an arrow A in FIG. 7A. The charging roller 5 is connected to a high-voltage supply source and uniformly applies electric charges to the photosensitive drum 3 to initialize the photosensitive layer on the circumferential surface of the drum 3. The photosensitive layer may be charged with positive or negative electric charges. The photosensitive layer of the drum 3 is uniformly charged with, for example, −650V. The recording head has a light source which emits laser beam or light generated by LEDs, and selectively irradiates the negatively charged photosensitive layer of the photosensitive drum 3 in accordance with image data supplied to the recording head from for example a host computer. The irradiated portion of the negatively charged photosensitive layer of the photosensitive drum 3 is decreased in its potential to about −70V. As a result, an electrostatic latent image is formed by the low potential region (−70V) in the initially-charged high-potential region (−650V).

The developing subunit 2 has a casing 10 serving also as a toner hopper. A waste toner collecting bag 11 is provided in an upper interior portion of the casing 10, and a developing roller 12 is provided in a lower opening of the casing 10. The waste toner collecting bag 11 is used for collecting a waste toner discharged from the cleaner 4 by way of the waste toner discharge pipe 9. The developing roller 12 is rotatable with being in pressure-contact with the photosensitive drum 3. The casing 10 is filled with non-magnetic toner 13. A toner stirring member 14 is disposed in a lower interior portion of the casing 10 and is buried in the toner 13. A toner feed roller 15 made of sponge is also provided under the stirring member 14 in the lower interior portion of the casing 10 and is pressed against the developing roller 12. A leaf-spring like doctor blade 16 is further provided in the lower interior portion and is in pressure-contact with the circumferential surface of the developing roller 12 from an upper-right side thereof. A developing-portion scooping sheet 17 made of an insulating film is further disposed in the lower opening of the casing 10 and is in contact with the circumferential surface of the developing roller 12 from a lower side thereof. The scooping sheet 17 is fixed in the lower opening by a press board 19. Sealing members 18*a* are provided on both sides of the doctor blade 16, and other sealing members 18*b* are provided on both sides of the developing roller 12. These sealing members 18*a*, 18*b* prevent the toner 13 from leaking out from the casing 10 through both sides of the doctor blade 16 and those of the developing roller 12 in the lower opening of the casing 10.

The sealing members 18*a*, 18*b*, doctor blade 16, scooping sheet 17 and press board 19 arranged from right to left in FIG. 7B are installed in the lower interior portion of the casing 10 in this order through the lower opening as shown in FIG. 7C. After these members are provided in the lower interior portion of the casing 10, both end portions of the developing roller 12 are inserted in a pair of roller supporting portions 20 in the lower opening of the casing 10 as indicated by an arrow D and are supported by a pair of bearings mounted on the supporting portions 20.

When the both end portions of the developing roller 12 are inserted in the roller supporting portions 20 and supported by the bearings, the developing roller 12 is pressed on the lower sealing members 18*b*, whereby the lower sealing members 18*b* come into contact with the developing roller 12. Similarly, the developing roller 12 presses the doctor blade 16 to bent it a predetermined amount, thereby permitting the upper sealing members 18*a* to come into contact with the doctor blade 16. The photosensitive drum 3 is the widest member of the structural members the image forming unit. The developing roller 12 is smaller in width than the photosensitive drum 3, and a central portion of the developing roller 12 arranged between the both end portions thereof with which the upper sealing members 18*a* are in contact defines an effective developing region on the circumferential surface of the drum 3. The width of the toner scooping sheet 7 and that of the scratching blade 8 in the cleaner 4 shown in FIG. 7A are shorter than that of the photosensitive drum 3 but longer than that of the developing roller 12.

In this structure, the toner stirring member 14 of the developing subunit 2 (shown in FIG. 7A) rotates to stir the toner 13 and to feed the toner 13 toward the feed roller 15 positioned below the stirring member 14. A feed bias voltage of, for example, −500V is applied to the feed roller 15 by a bias power supply, and the feed roller 15 rotates in the counterclockwise direction as indicated by an arrow C in the figure while the feed roller 15 presses its sponge surface on the developing roller 12. Therefore, the feed roller 15 supplies the toner 13 to the circumferential surface of the developing roller 12 in a rubbing manner. A developing bias of −250V is applied to the developing roller 12 by a bias power supply, and the developing roller 12 rotates in the counterclockwise direction as indicated by an arrow B in the figure. The doctor blade 16, which is appropriately pressed against the circumferential surface of the developing roller 12, gives a weak negative triboelectric charge to the toner 13 to assist an attraction of the toner 13 onto the developing roller 12, and controls a thickness of a toner layer attracted on the developing roller 12 in a predetermined value. The developing roller 12 transports the toner layer by its rotation to a position (developing portion) facing the photosensitive drum 3.

At the position where the developing roller 12 faces the photosensitive drum 3 of the drum subunit 1, a potential difference of −180V is produced between the low potential region (−70V), that is the statistic latent image, formed on the photosensitive drum 3 and the developing roller 12 (−250V). This means that the low potential region (the electrostatic latent image) is positively charged relative to the developing roller 12. This causes the negatively charged nonmagnetic toner 13 to transfer from the developing roller 12 to the relatively positively-charged low potential region (electrostatic latent image) formed on the photosensitive drum 3 and to form a toner image (reversal development). The toner image developed from the latent image on the circumferential surface of the photosensitive drum 3 is transported by the rotation of the drum 3 to a lower end of the photosensitive drum 3. Since a paper sheet (not shown) moved from right to left in the figure contacts the lower end of the photosensitive drum 3, the toner image on the circumferential surface of the photosensitive drum 3 is transferred onto the paper sheet and then thermally fixed thereon by a fixing device (not shown).

After completion of the image transfer onto the paper sheet, a small amount of toner which can not be transferred remains on the circumferential surface of the photosensitive drum 3. The remaining toner on the drum is passed under the cleaner scooping sheet 7 and is introduced into the cleaner 4. Finally, the remaining toner is scratched off from the photosensitive drum 3 by the scratching blade 8, and the cleaner scooping sheet 7 scoops the scratched-off toner to prevent it from leaking out from the cleaner 4.

The developing device of the conventional image forming unit mentioned above has a following problem. When a solid image having a large area is developed, a density gradation often appears in a printed solid image on a paper sheet. The density gradation is produced by a first part of the solid image developed by a first round of the developing roller 12 and a second part or the following parts of the solid image developed by a second round or the following rounds thereof. This is, until a development of a solid latent image by the developing roller 12 is started, the developing roller 12 has made a plurality of rotations so that the feed roller 15 also has made a plurality of rotations to supply the toner to the roller 12 many times and the doctor blade 16 has given triboelectric charges to the roller 12 many times, thereby increasing the density of the toner layer on the roller 12. As a result of this, the developing roller 12 develops the solid image on the photosensitive drum 3 with the high-density toner layer during the first rotation of the roller 12, and the toner is scarcely left on the developing roller 12. In the second rotation and the following rotations of the developing roller 12 during the development of the drum 3, the toner layer is formed on the roller 12 by only one supply of the toner from the supply roller 15 and only one give of the triboelectric charge to the toner layer on the roller 12 from the doctor blade 16. The new toner layer formed on the roller 12 by one toner supply and one triboelectric-charging is low in toner density compared to the toner layer formed by a plurality of toner supplies and a plurality of triboelectric-charging. This is the reason, why the density gradation (hereinafter referred to as "development memory") as mentioned above takes place.

This problem (the phenomenon of the development memory) may be overcome if the toner deposited on the circumferential surface of the developing roller 12 is completely removed just after the circumferential surface of the developing roller 12 is separated from the developing portion at which the roller 12 contacts the photosensitive drum 3, and then the toner 13 is newly supplied to the roller 12 in the casing 10. If so, the toner layer is always formed on the roller 12 in every one rotation of the roller 12 by one toner supply and one triboelectric-charging. Consequently, the phenomenon of the development memory should be overcome. In the conventional image forming unit mentioned above, the rotational direction of the feed roller 15 is opposite to that of the developing roller 12 at a toner feed portion at which the feed roller 15 contacts the developing roller 12, and the feed roller 15 rubs the developing roller 12 at the toner feed portion not only to feed the toner onto the developing roller 12 but also to remove the residual toner, which was not used to develop the latent image on the drum 3, from the roller 12.

However, the phenomenon of the development memory has not yet been overcome by the aforementioned structure of the conventional image forming unit. To overcome the phenomenon of the development memory, it is known to set a scratching member, which serves exclusively as a toner scraper, to abut against the circumferential surface of the developing roller 12. However, this scratching member makes the overall size of the developing subunit increase. In addition, this scratching member further makes the driving force of the developing roller 12 larger, and hence the developing subunit requires a large motor and a strong driving force transmitting system. These large motor and the strong driving force transmitting system further makes the developing subunit inevitably increase its overall size and its manufacturing cost.

BRIEF SUMMARY OF THE INVENTION

The present invention has been made under the aforementioned circumstances, and an object of the present invention is to provide a developing device having a simple structure and capable of developing an image always with a uniform density without the phenomenon of the development memory even if an area of the image is large, and to provide an image forming unit and a color image forming apparatus, both having the developing device.

In order to achieve the aforementioned object of the present invention, the developing device according to the present invention comprises:

- a developing hopper which has an opening facing an image carrier on which an electrostatic latent image is formed, and stores a single-component nonmagnetic toner;
- a developing roller which is provided in the opening to expose a part of its circumferential surface, makes a developing portion between the part of the circumferential surface and the image carrier, and carries the nonmagnetic single-component toner on the circumferential surface thereof to transport the single-component nonmagnetic toner to the developing portion from the hopper and to develop the electrostatic latent image on the image carrier at the developing portion;

a doctor blade which contacts the circumferential surface of the developing roller in an upstream side of the developing portion in a rotational direction of the developing roller, and controls a thickness of the toner carried on the circumferential surface of the developing roller;

a toner feed roller which is arranged in the developing hopper and is pressed on the developing roller in an upstream side of the doctor blade in the rotational direction of the developing roller to feed the toner in the hopper to the circumferential surface of the developing roller;

a conductive sheet member which contacts the circumferential surface of the developing roller in a downstream side of the developing portion and in an upstream side of the toner feed roller in the rotational direction, permits a residual toner not used to develop the electrostatic latent image on the image carrier at the developing portion and left on the developing roller to pass into the developing hopper, and prevents the toner in the developing hopper from leaking out along the circumferential surface of the developing roller in the downstream side of the developing portion and in the upstream side of the toner feed roller in the opening;

a bias voltage apply equipment which applies a bias voltage having the same polarity as that of a charge characteristic of the toner, to the developing roller; and a conductive sheet bias equipment which applies a sheet bias voltage, ranging from 0V to the bias voltage applied to the developing roller, to the conductive sheet member to generate a potential difference between the conductive sheet member and the developing roller, thereby weaking an attachment of the residual toner to the developing roller.

In the developing device according to the present invention and constructed as mentioned above, the conductive sheet bias equipment is so preferably constructed that it sets a value of the sheet bias voltage applied to the conductive sheet member on the basis of an amount of a charge of the toner. Furthermore, the value of the sheet bias voltage is preferably set in such a manner that the larger the amount of the charge of the toner is, the larger the difference between the sheet bias voltage and the bias voltage applied to the developing roller is, and the smaller the amount of the charge of the toner is, the smaller the difference between the sheet bias voltage and the bias voltage applied to the developing roller is.

Moreover, the developing device according to the present invention and constructed as mentioned above preferably further comprises:

a detection equipment which detects the number of image formings of the image carrier; and a sheet bias voltage controlling equipment which varies the sheet bias voltage applied to the conductive sheet member to make the sheet bias voltage being closer to the bias voltage applied to the developing roller in response to an increase of the number of image formings of the image carrier detected by the detection equipment.

The developing roller is preferably pressed on the image carrier to form the developing portion therebetween and the bias voltage apply equipment preferably further applies a feed bias voltage having the same polarity as that of the charge characteristic of the toner, to the toner feed roller.

In order to achieve the aforementioned object of the present invention, an image forming unit according to the present invention and removably attached to an image forming apparatus comprises:

a developing hopper which has an opening facing an image carrier on which an electrostatic latent image is formed, and stores a single-component nonmagnetic toner;

a developing roller which is provided in the opening to expose a part of its circumferential surface, makes a developing portion between the part of the circumferential surface and the image carrier, and carries the nonmagnetic single-component toner on the surface thereof to transport the single-component nonmagnetic toner to the developing portion from the hopper and to develop the electrostatic latent image on the image carrier at the developing portion;

a doctor blade which contacts the circumferential surface of the developing roller in an upstream side of the developing portion in a rotational direction of the developing roller, and controls a thickness of the toner carried on the circumferential surface of the developing roller;

a toner feed roller which is arranged in the developing hopper and is pressed on the developing roller in an upstream side of the doctor blade in the rotational direction of the developing roller to feed the toner in the hopper to the circumferential surface of the developing roller; and a conductive sheet member which contacts the circumferential surface of the developing roller in a downstream side of the developing portion and in an upstream side of the toner feed roller in the rotational direction, permits a residual toner not used to develop the electrostatic latent image on the image carrier at the developing portion and left on the developing roller to pass into the developing hopper, prevents the toner in the developing hopper from leaking out along the circumferential surface of the developing roller in the downstream side of the developing portion and in the upstream side of the toner feed roller in the opening;

wherein the conductive sheet member is electrically connected to a conductive sheet member bias equipment provided in the image forming apparatus when the image forming unit is attached to the image forming apparatus.

The image forming unit according to the present invention and constructed as mentioned above preferably includes an image carrier subunit having the image carrier and a developing subunit which is united with the image carrier subunit and is removably attached to the image forming unit, and the developing roller is pressed on the image carrier to form the developing portion. Furthermore, in an image forming apparatus to which the image forming unit according to the present invention and constructed as mentioned above is removably attached, the developing roller is preferably applied with a bias voltage from a bias voltage apply equipment provided in the image forming apparatus, the bias voltage having the same polarity as that of a charge characteristic of the toner, the conductive sheet bias equipment is preferably so constructed to apply a sheet bias voltage, ranging from 0V to the bias voltage applied to the developing roller, to the conductive sheet member to generate a potential difference between the conductive sheet member and the developing roller, thereby weaking an attachment of the residual toner to the developing roller.

In order to achieve the object of the present invention, a color image forming apparatus according to the present invention comprises a plurality of developing devices, each of the developing devices comprising:

a developing hopper which has an opening facing an image carrier on which an electrostatic latent image is formed, and stores a single-component nonmagnetic toner;

a developing roller which is provided in the opening to expose a part of its circumferential surface, makes a developing portion between the part of the circumferential surface and the image carrier, and carries the nonmagnetic single-component toner on the surface thereof to transport the single-component nonmagnetic toner to the developing portion from the hopper and to develop the electrostatic latent image on the image carrier at the developing portion;

a doctor blade which contacts the circumferential surface of the developing roller in an upstream side of the developing portion in a rotational direction of the developing roller, and controls a thickness of the toner carried on the circumferential surface of the developing roller;

a toner feed roller which is arranged in the developing hopper and is pressed on the developing roller in an upstream side of the doctor blade in the rotational direction of the developing roller to feed the toner in the hopper to the circumferential surface of the developing roller;

a conductive sheet member which contacts the circumferential surface of the developing roller in a downstream side of the developing portion and in an upstream side of the toner feed roller in the rotational direction, permits a residual toner not used to develop the electrostatic latent image on the image carrier at the developing portion and left on the developing roller to pass into the developing hopper, and prevents the toner in the developing hopper from leaking out along the circumferential surface of the developing roller in the downstream side of the developing portion and in the upstream side of the toner feed roller in the opening;

a bias voltage apply equipment which applies a bias voltage having the same polarity as that of a charge characteristic of the toner, to the developing roller; and a conductive sheet bias equipment which applies a sheet bias voltage, ranging from 0V to the bias voltage applied to the developing roller, to the conductive sheet member to generate a potential difference between the conductive sheet member and the developing roller, thereby weaking an attachment of the residual toner to the developing roller.

The conductive sheet bias equipment is preferably so constructed that it sets a value of the sheet bias voltage applied to the conductive sheet member on the basis of an amount of a charge of the toner.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 3A is a table showing a change of a condition of a development memory with a change of an amount of a triboelectric charge of a toner and a change of a conductive sheet (scooping sheet) bias;

FIG. 3B is a table showing a change of a condition of an image defect (a toner transportation malfunction) with the change of the amount of the triboelectric charge of the toner and the change of the conductive sheet (scooping sheet) bias;

Next, an embodiment of the present invention will be explained with reference to the accompanying drawings.

DETAILED DESCRIPTION OF THE INVENTION

Figure 1:
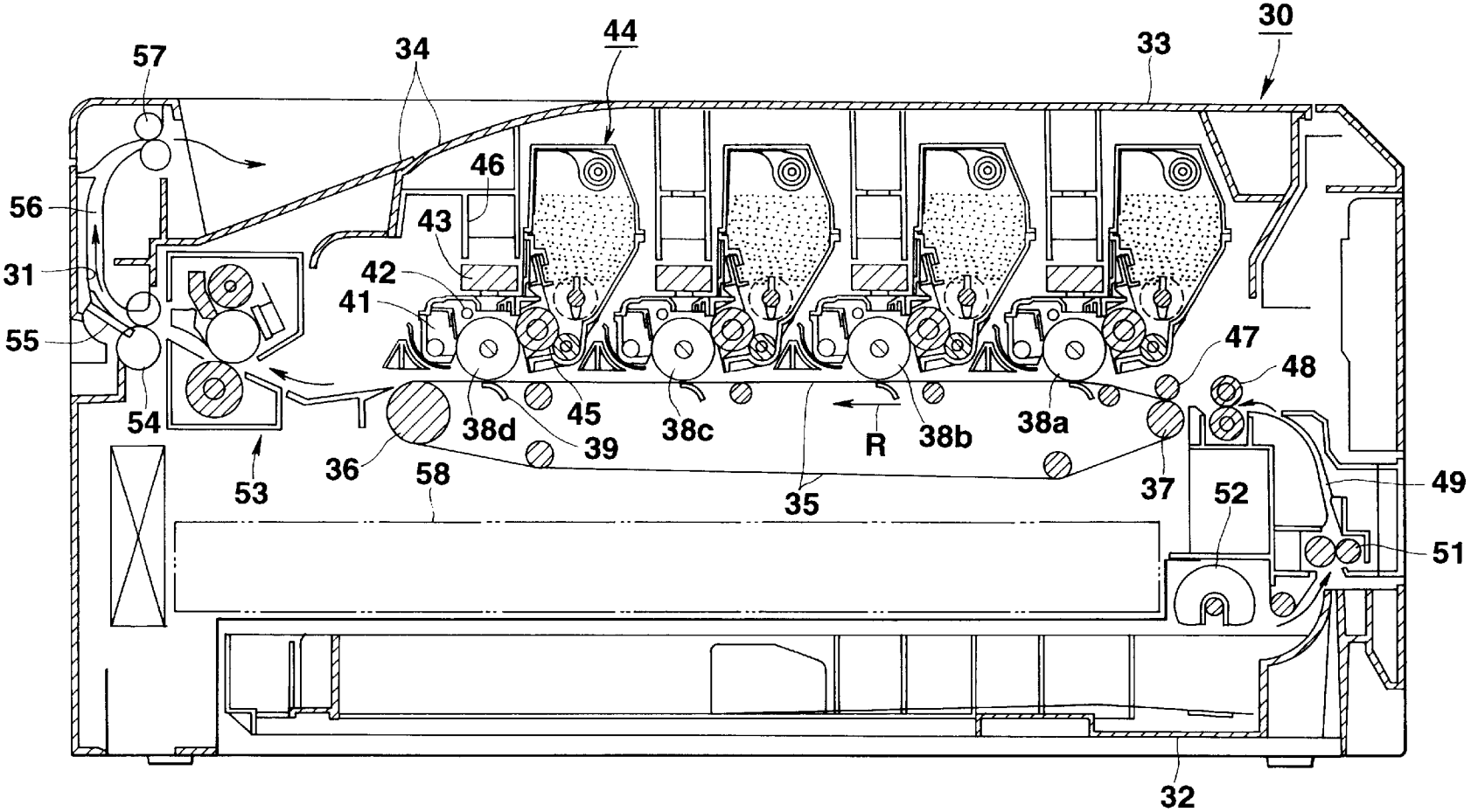
FIG. 1 is a longitudinal-sectional view of a color image forming apparatus according to an embodiment of the present invention.

FIG. 1 schematically shows an inner structure of a color image forming apparatus according to an embodiment of the present invention. At first, an entire structure of the color image forming apparatus will be explained with reference to FIG. 1. As shown in FIG. 1, the color image forming apparatus 30 has an auxiliary discharge tray 31 provided in a rear wall of an outer housing to be rotatable between a vertical closed position and a horizontal opening position, and a sheet cassette 32 detachably mounted in a lower part of an interior of the outer housing. The sheet cassette 32 can be removed from the lower part through a lower opening of a front wall of the outer housing and stores a plurality of stacked paper sheets. An upper wall of the outer housing is structured by a top cover 33 which is rotatable around its rear end portion between a horizontal closed position and a vertical opening position. A power-supply switch, a liquid-crystal display, and a plurality of input keys those of which are not shown in FIG. 1 are arranged on a front lateral portion of an upper surface of the top cover 33. A rear portion of the upper surface of the top cover 33 forms a main discharge tray 34.

In a center of the interior of the outer housing, a conveyer belt 35 horizontally extending in back and forth directions is disposed. Both ends of the conveyor belt 35 are hung on a driving roller 36 and a follower roller 37. When the belt 35 is driven by the driving roller 36, the belt 35 circulates in the counterclockwise direction indicated by an arrow R in FIG. 1. Four photosensitive drums 38*a*, 38*b*, 38*c*, and 38*d* are arranged tandemly along an upper surface of an upper extending portion of the belt 35 in this order in a moving direction of the upper extending portion.

Each of the photosensitive drums 38*a*, 38*b*, 38*c*, and 38*d* is surrounded by a cleaner 41, an initializing charge roller 42, a writing head 43, and a developing device 44 (in order to clarify FIG. 1, only those members surrounding the drum 38*d* are designated by the reference numerals). Four sheet shaped contact-type image transferring devices 39 press a lower surface of the upper extending portion of the belt 35 against the lower ends of the drums 38*a*, 38*b*, 38*c*, and 38*d* to form four toner image transfer portions therebetween.

Each of the developing devices 44 includes a developing hopper having a lower opening facing the corresponding drum 38*a*, 38*b*, 38*c*, or 38*d*, and a developing roller 45 is provided in the opening so that the developing roller 45 is in contact with the circumferential surface of the corresponding photosensitive drum 38*a*, 38*b*, 38*c*, or 38*d* to form a developing portion therebetween. Each writing head 43 is fixed on a lower surface of the top cover 33 by a supporting member 46, so that each writing head 43 swingably moves up and down with the rotation of the top cover 33 between the vertical opening position and the horizontal closed position. When the top cover 33 is positioned at its horizontal closed position as shown in FIG. 1, each writing head 43 moves down and set between the initializing charge roller 42 and the developing roller 45 in each developing device 44 to form a recording portion.

An attraction roller 47 is in contact with an upstream end of the upper extending portion of the belt 35 in the moving direction of the upper extending portion, to pinch the belt 35 with the follower roller 37, thereby forming a sheet loading portion. The attraction roller 47 presses a sheet supplied to the sheet loading portion from the sheet cassette 32 through a sheet supply mechanism, on the upper surface of the upper extending portion of the belt 35, and applies an attraction bias to the sheet so that the sheet is electrostatically attracted on the upper surface of the upper extending portion of the belt 35.

The developing hoppers of the developing devices 44 arranged along the upper extending portion of the belt 35 from the upstream end toward the down stream end thereof in the moving direction of the upper extending portion of the belt 35, respectively store color toners, namely three primary colors of subtractive color mixture, such as magenta, cyan, and yellow; and a black toner to be used exclusively for printing letters and images in black, in this order.

In this embodiment, the developing devices 44, together with the corresponding photosensitive drums 38*a*, 38*b*, 38*c* and 38*d* and the above described various members arranged to surround each of the photosensitive drums, are detachably installed in predetermined positions along the upper surface of the upper extending portion of the belt 35 in the outer housing, and can be removed from the predetermined positions when the top cover 33 is located in the vertical opening position.

A stand-by roller pair 48 is positioned near to the loading portion, and a sheet supply guide path 49 extends from the stand-by roller pair 48 to an upper front end opening of the cassette 32. A sheet supply roller pair 51 is disposed near to the upper front end opening of the cassette 32 in the sheet supply guide path 49. A pick-up roller 52 is arranged above the upper front end opening of the sheet cassette 32.

A paper discharge path 56 extends from the downstream end of the upper extending portion of the belt 35 to the main discharge tray 34, and an intermediate portion of the path 56 extends vertically along the auxiliary discharge tray 31 arranged at its vertical closed position. A fixing device 53, a first paper-discharge roller pair 54, and a switching lever 55 are arranged in this order along a front half of the discharge path 56 between the downstream end of the upper extending portion of the belt 35 and the auxiliary discharge tray 31. The fixing device 53 includes a pressure roller, a fixing roller, a heating roller, a paper-separation claw, a circumferential surface cleaner, an oil coating member, a thermistor, etc., all of which are housed in a heat-insulating box. Further, a second paper-discharge roller pair 57 is arranged at a rear end opening of the discharge path 56 opening to the main discharge tray 34.

The switching lever 55 is moved between a lower opening position and an upper closed position in response to the rotatable movement of the auxiliary discharge tray 31. More specifically, when the auxiliary discharge tray 31 is arranged at the vertical closed position as shown in FIG. 1, the switching lever 55 is arranged at the lower opening position and guides a paper sheet from the first discharge roller pair 54 to the second paper discharge roller pair 57, that is to the main discharge tray 34. When the auxiliary discharge tray 31 is arranged at its horizontal opening position, the switching lever 55 is arranged at the upper closing position and guides a paper sheet from the first discharge roller pair 54 toward the auxiliary discharge tray 31.

An electric equipment installation area for installing circuit substrates 58, is formed between the conveyer belt 35 and the sheet cassette 32. On the circuit substrates 58, a control device includes a plurality of electric and electronic parts is mounted.

The control device includes a controller portion and an engine portion. The controller portion has a CPU (Central Processing Unit), a ROM (Read Only Memory), an EEPROM (Electrically Erasable and Programmable Read Only Memory), a frame memory, an image data transmitting circuit, etc . . . . The controller portion analyzes a printing data input by a host computer located in the outside of the color image forming apparatus 30 and connected to the controller portion, forms an image data and transmits it to the engine portion.

The engine portion has a CPU, a ROM, etc . . . . Data and a command signal from the controller portion, an output from a thermo-sensor, an output from a sheet detection sensor, etc., are input to an input side of the engine portion. Connected to an output side thereof are a motor driver for driving a motor (not shown), a clutch driver for switching a driving system to transmit a driving force from the motor to each of structural elements which need the driving force in the color image forming apparatus, a printing driver for driving the writing heads 43 on the basis of the image data, and a bias power-supply driver for supplying predetermined bias voltages to the initializing charge rollers 42, developing rollers 45, transfer devices 39, attraction roller 47, a toner feed roller (described later), a doctor blade (described later), a developing-portion scooping sheet (described later), and the like. The engine portion controls each drivers described above on the basis of the data and command signals from the controller portion, the output from the thermo-sensor, the output from the sheet detection sensor and the like.

Next, a basic operation of the color image forming apparatus 30 will be explained. When the power-supply switch is turned on, and then the printing data such as a paper quality and the number of the paper sheets to be printed, a printing-letter mode, and other items are input into the control device from the host computer, the pick-up roller 52 rotates, the number of the rotations of which corresponds to the number of the paper sheets to be printed. In each rotation, the pick-up roller 52 picks up the upper most paper sheet in the sheet cassette 32 to the sheet supply roller pair 51, and then the supply roller pair 51 supplies the picked up paper sheet toward the stand-by roller pair 48 through the sheet supply guide path 49. When the leading end of the picked-up paper sheet is lightly pressed against a paper waiting portion between a pair of rollers of the stand-by roller pair 48, a skew of the picked-up paper sheet is amended and the sheet supply roller pair 51 stops its rotation to stop the supply of the picked-up sheet.

When the printing data is input, the driving roller 36 also starts its rotation in the counterclockwise direction and the conveyor belt 35 starts its circulation in the counterclockwise direction with the upper extending portion of the conveyer belt 35 being in contact with the four photosensitive drums 38*a*, 38*b*, 38*c* and 38*d* of the four image forming units 44.

At the same time, at least one of the developing devices 44 needed for a printing in accordance with the printing data is started for its operation. More specifically, the photosensitive drum 38*a*, 38*b*, 38*c* or 38*d* of the at least one developing device 44 rotates in the clockwise direction, and the initializing charge roller 42 applies a high negative potential onto the circumferential surface of the photosensitive drum 38*a*, 38*b*, 38*c* or 38*d*, uniformly. The writing head 43 irradiates the circumferential surface of the photosensitive drum 38*a*, 38*b*, 38*c* or 38*d* with light in accordance with the image signal supplied from the printing driver of the control device to the writing head 43, thereby forming a low potential region (an electrostatic latent image) in the initially charged high potential region on the drum. The developing roller 45 corresponding to the drum 38*a*, 38*b*, 38*c*, or 38*d* develops the low potential region with toner (reversal development) to form a toner image on the circumferential surface of the photosensitive drum.

The stand-by roller pair 48 and the sheet supply roller pair 51 start their rotation to supply the paper sheet to the sheet loading portion, so that a predetermined position on the paper sheet to which a leading end of the toner image will be transferred reaches the transfer portion when the leading end of the toner image on the photosensitive drum 38*a*, 38*b*, 38*c*, or 38*d* reaches the transfer portion.

At the sheet loading portion, the attraction roller 47 presses the paper sheet supplied from the stand-by roller pair 48 on the upstream end of the upper surface of the upper extending portion of the belt 35. The paper sheet is attracted onto the upper surface of the upper extending portion of the belt 35 by the attraction bias applied from the attraction roller 47 and is transferred to the four transfer portions formed between the four photosensitive drums 38*a*, 38*b*, 38*c*, and 38*d* and the four photosensitive drums 38*a*, 38*b*, 38*c* and 38*d* of the four developing devices 44.

The transfer device 39 corresponding to each developing device 44 which is used to form a toner image, applies a transfer bias to the toner image on the corresponding photosensitive drum 38*a*, 38*b*, 38*c*, or 38*d*, so that the toner image is transferred onto the paper sheet transported on the upper surface of the upper extending portion of the belt 35.

In this embodiment, all of the four developing devices 44 are used to form the four toner images. Therefore, a M (magenta) toner image is transferred onto the sheet on the upper surface of the upper extending portion of the belt 35 from the photosensitive drum 38*a* of the first developing device 44 located firstly nearest to the upstream end, a C (cyan) toner image is transferred onto the sheet from the photosensitive drum 38*b* of the second developing device 44 located secondly nearest to the upstream end, an Y (yellow) toner image is transferred onto the sheet from the photosensitive drum 38*c* of the third developing device 44 located thirdly nearest to the upstream end, and a Bk (black) toner image is transferred onto the sheet from the photosensitive drum 38*d* of the fourth developing device 44 located fourthly nearest to the upstream end or firstly nearest to the downstream end.

The paper sheet on which the above described four color images are sequentially transferred is separated from the upper surface of the upper extending portion of the belt 35 at its downstream end and guided into the fixing device 53. The fixing device 53 thermally fixes the four toner images on the sheet. After passing through the fixing device 53, the sheet is discharged by the first and second discharge roller pairs 54 and 57 onto the main discharge tray 34 when the auxiliary discharge tray 31 is located at its vertical closed position and the switching lever 55 is located at its lower opening position, as shown in FIG. 1, or by only the first discharge roller pair 54 onto the auxiliary discharge tray 31 when the auxiliary discharge tray 31 is located at its horizontal opening position and the switching lever 55 is located at its upper closing position.

On the main discharge tray 34 the paper sheet faces its fixed toner images downward, and on the auxiliary discharge tray 31 the paper sheet faces its fixed toner images upward.

In the above described color image forming device 30 according to the embodiment of the present invention, each of the developing devices 44 has a characteristic structure described below in order to form a stable toner image on each of the photosensitive drums 38*a*, 38*b*, 38*c*, and 38*d*.

Figure 2:
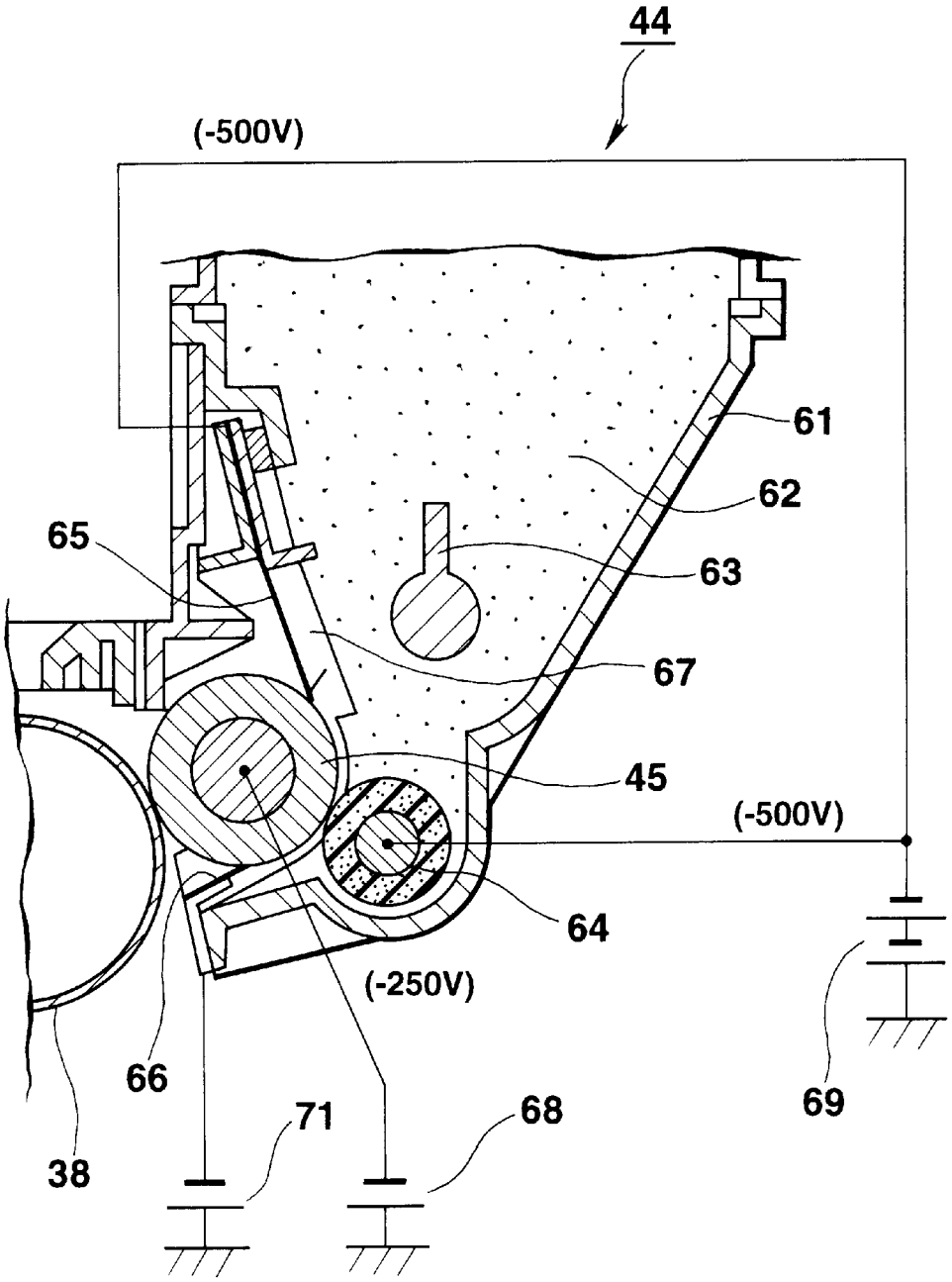
FIG. 2 is a vertical-sectional view of a main portion of a developing device of the color image forming apparatus according to the embodiment of the present invention.
Figure 7A:
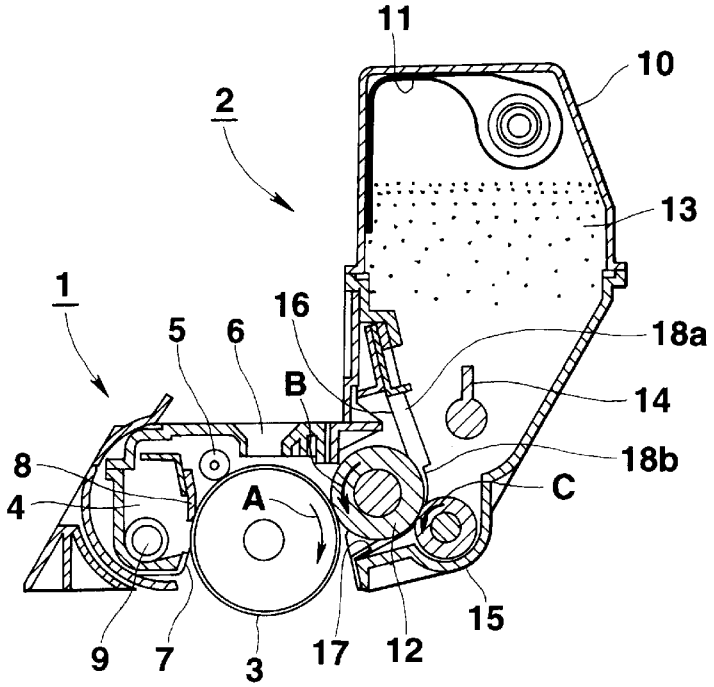
FIG.7A (PRIOR ART)
FIG. 7A is a vertical-sectional view of a conventional image forming unit.
Figure 7B:
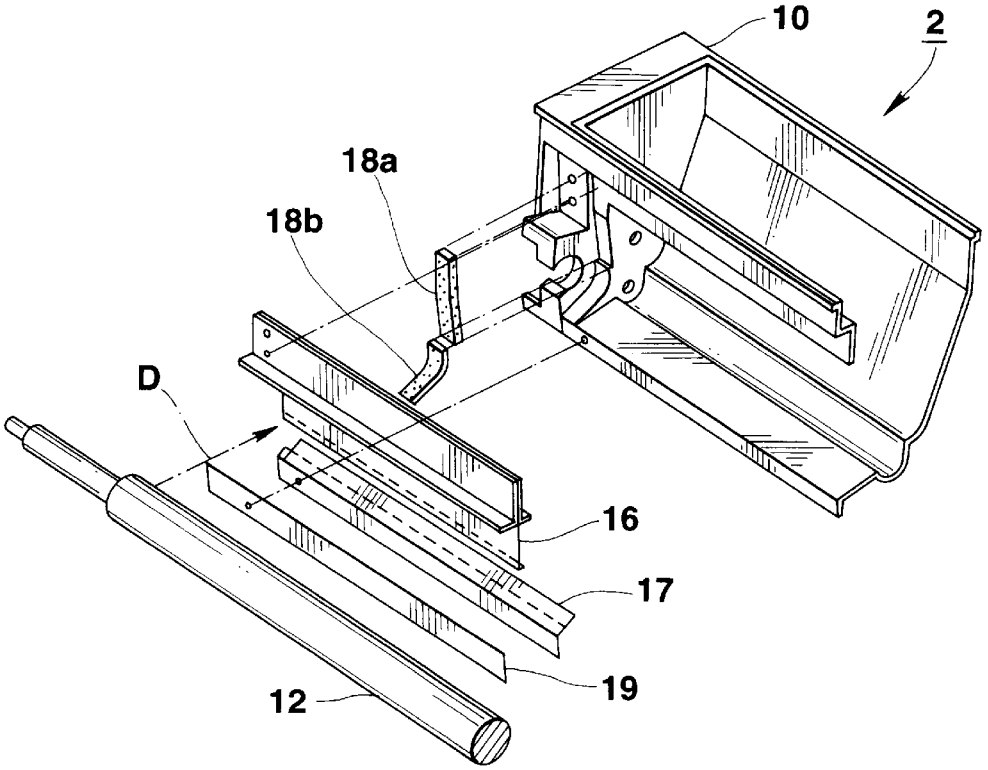
FIG.7B (PRIOR ART)
FIG. 7B is an exploded oblique view of a main portion of a conventional developing device, the developing device being provided, as a subunit, in the conventional image forming unit.
Figure 7C:
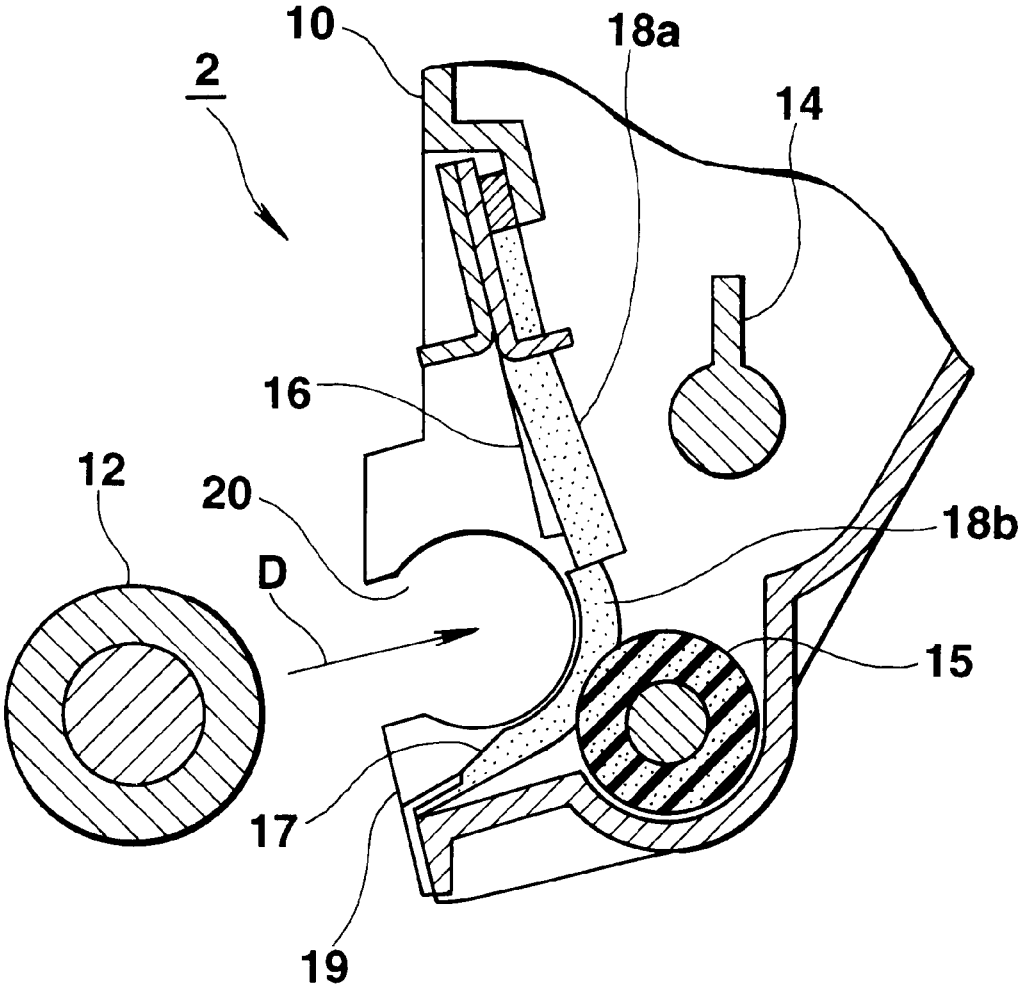
FIG.7C (PRIOR ART)
FIG. 7C is a vertical-sectional view showing the main portion of the conventional developing device in a state that a developing roller is removed.

FIG. 2 is a vertical sectional view schematically showing a main portion of one of the four developing devices 44. Each of the developing devices 44 has the same structure as to each other, and almost all of the structure is the same as that of the conventional developing subunit 2 shown in FIGS. 7A to 7C. That is, the developing device 44 has a casing 61 which serves also a toner hopper and has a lower opening. A developing roller 45 formed of a conductive rubber is rotatably supported in the lower opening of the casing 61. The casing 61 is filled with a nonmagnetic toner 62, and a toner stirring member 63 is mounted in a lower portion of an inner space of the casing 61 and is buried in the toner 62. The developing roller 45 exposes a part of its circumferential surface in an outside of the casing 61 through the lower opening. A sponge-formed feed roller 64 is arranged in a lower end of the inner space of the casing 61 and is in pressure-contact with the circumferential surface of the developing roller 45. A doctor blade 65 of a metal leaf spring is arranged in the lower portion of the inner space of the casing 61 and contacts an upper right position on the circumferential surface of the developing roller 45. A developing-portion scooping sheet (conductive sheet) 66 is further arranged in the lower opening of the casing 61 and contacts a lower end position of the circumferential surface of the developing roller 45. A pair of sealing members 67 are arranged both lateral ends of the doctor blade 65 to prevent the toner 62 in the inner space of the casing 61 from leaking out through a pair of gaps between the lateral ends of the doctor blade 65 and inner surfaces of a pair of lateral walls of the casing 61.

After the image is developed on the photosensitive drum designated by a reference numeral 38 as a representative of the four reference numerals 38*a*, 38*b*, 38*c*, and 38*d*, in order to cancel the development memory, the residual toner 62 left, mainly at the non-developed portion, on the circumferential surface of the developing roller 45 is rubbed off by the feed roller 64. The rubbing force of the feed roller 64 varies depending upon the attraction force of the toner 62 to the developing roller 45. That is, when the toner attraction force is strong, a strong rubbing force is required. When the toner attraction force is weak, a weak rubbing force is required. The attraction force of the toner 62 to the developing roller 45 is virtually determined by the amount of the triboelectrical charge of the toner 62. More specifically, the smaller the amount of the triboelectrical charge is, the weaker the attraction force is so that the toner can be more easily rubbed off from the developing roller 45.

However, the triboelectrical charge of the toner 62 is generated by the sliding contact with the doctor blade 65, and the amount of the triboelectrical charge of the toner 62 is closely related with a defective phenomenon called as "fogging of a photosensitive layer" in which the toner is attracted onto the non image forming portion (that is, the uniformly high potential area) on the photosensitive drum 38. And, the smaller the amount of the charge of the toner 62 is, the easier the fogging phenomenon occurs. To prevent the fogging phenomenon, it is necessary to increase the amount of triboelectric charge of the toner 62. But, when the amount of triboelectric charge of the toner 62 increases, the toner 62 attracts onto the developing roller 45 more strongly. It is therefore necessary to make the feed roller 64 generate the stronger rubbing force to the developing roller 45 to cancel the development memory.

If the feed roller 45 is rotated for a long time while it applies such a strong rubbing force to the development roller 45, the characteristics of the toner such as the charging ability and flowability decrease. For example, if the amount of the charge of the toner decreases, the fogging phenomenon mentioned above occurs. If the flowability of the toner decreases, a white spot will be generated in the toner image on the photosensitive drum.

In order to cancel the above described various disadvantages such as the development memory, the fogging phenomenon, the defective of the toner characteristics, etc., the developing device 44 according to the embodiment of the present invention is further characteristically structured as follows. The developing roller 45 is formed of a core metal and a cylindrical semiconductive ($10^6$ Ωcm) urethane rubber surrounding the core metal. A developing bias of −250V is applied to the metal core by a bias power supply 68. The feed roller 64 is formed of a core metal and a cylindrical semiconductive ($10^6$ Ωcm) urethane sponge surrounding the core metal. A feed bias of −500V is applied to the core metal by a bias power supply 69. Furthermore, the doctor blade 65 is formed of an elastic metal plate, and a doctor bias of −500V is applied to the doctor blade 65 by the aforementioned bias power supply 69. The developing-portion scooping sheet 66 is formed of a conductive member ($10^3$ Ωcm), and a sheet bias voltage ranging from 0V to the developing bias voltage of the developing roller 45 can be applied by a bias power supply 71 to the scooping sheet 6.

It is the characteristic structure of the present invention that the developing-portion scooping sheet 66 is formed of the conductive material and the sheet bias voltage ranging from 0V to the developing bias voltage of the developing roller 45 is applied to the scooping sheet 66. This structure can be able to reduce the amount of the charge of the residual toner 62 attached on the developing roller 45. By virtue of this, the feed roller 64 can easily rub off the residual toner on the developing roller 45 with a relatively small rubbing force applied by the feed roller 64 to the developing roller 45.

Further, each of the bias power supplies 68, 69 and 71 are independently installed in the outer housing of the printer 30 from each of the four developing devices 44 and are detachably electrically connected to the core metal of the developing roller 45, the core metal of the toner feed roller 64, the doctor blade 65, and the conductive scooping sheet 66 when the four developing devices 44 are set in the predetermined positions in the outer housing. These connections between the bias power supplies 68, 69 and 71 and the core metals of the toner feed roller 64 and the developing roller 45, the doctor blade 65 and the scooping sheet 66 are released when the top cover 33 is located in the vertical opening position and the developing devices 44 are removed from their corresponding predetermined positions.

In FIG. 2, the developing bias voltage is applied to the developing roller 45 by the bias power supply 68, and the sheet bias voltage is applied to the developing-portion scooping sheet 66 by the bias power supply 71, separately. However, the developing bias voltage and the sheet bias voltage can be applied from a common bias supply source which has a voltage dividing circuit containing a resistance element.

FIG. 3A is a table showing a change of a condition of the development memory with a change of an amount of a triboelectric charge of a toner and a change of a conductive sheet (scooping sheet) bias. FIG. 3B is a table showing a change of a condition of an image defect (a toner transportation malfunction) with the change of the amount of the triboelectric charge of the toner and the change of the conductive sheet (scooping sheet) bias.

And, the amount of the triboelectric charge of the toner was determined in the following method. First, the conductive scooping sheet 66 was removed from the developing device 44 and an insulating sheet conventionally used for preventing the toner from leaking out of the casing 61 was installed in place of the scooping sheet 66. Second, the casing 61 was filled with the toner 62, and an idling operation of the developing device was performed while the bias voltage is applied to the metal core of the developing roller 45, the metal core of the feed roller 64, and the doctor blade 65, so that the toner 62 is triboelectrically charged. Thirdly, the toner on the developing roller 45 was sucked and removed from the developing roller 45 while a faraday cage was connected to the developing roller 45. Finally, the amount of the triboelectric charge of the toner was obtained from the amount of the charge left on the developing roller 45 and that of the suctioned toner.

An evaluation of the condition of the development memory shown in FIG. 3A was conducted through a viewing inspection to toner images actually printed on paper sheets by the printing apparatus equipped with the developing device of the embodiment of the present invention while the sheet bias voltage varies.

As is apparent from FIG. 3A, to cancel the phenomenon of the development memory, in a case where the amount of the triboelectric charge of the negatively charged toner increases (proceed downward in the leftmost column), it is necessary to reduce the negative sheet bias voltage applied to the developing-portion scooping sheet 66 (to reduce the amount of the charge of the negatively charged toner, the sheet bias voltage must be shifted toward the plus side (toward 0V)). Whereas, in the case where the amount of the triboelectrical charge of the negatively charged toner decreases toward zero (proceed upward in the leftmost column), it does not need to reduce the sheet bias voltage of the developing-portion scooping sheet 66. In other words, the sheet bias voltage may be maintained at −250V or may be reduced toward 0V.

However, as is apparent from FIG. 3B, to cancel the image defect (the toner transportation malfunction), in a case where the amount of the triboelectric charge of the negatively charged toner increases (proceed downward in the leftmost vertical columns), it does not need to reduce the sheet bias voltage of the developing-portion scooping sheet 66. In other words, the sheet bias voltage may be maintained at −250V or may be reduced toward 0V. And, in a case where the amount of the triboelectrical charge of the negatively charged toner decreases (proceed upwards in the upper leftmost columns), it is necessary to increase the negative sheet bias voltage to be applied to the developing-portion scooping sheet 66 (maintains at −250V or around).

Figure 4A:
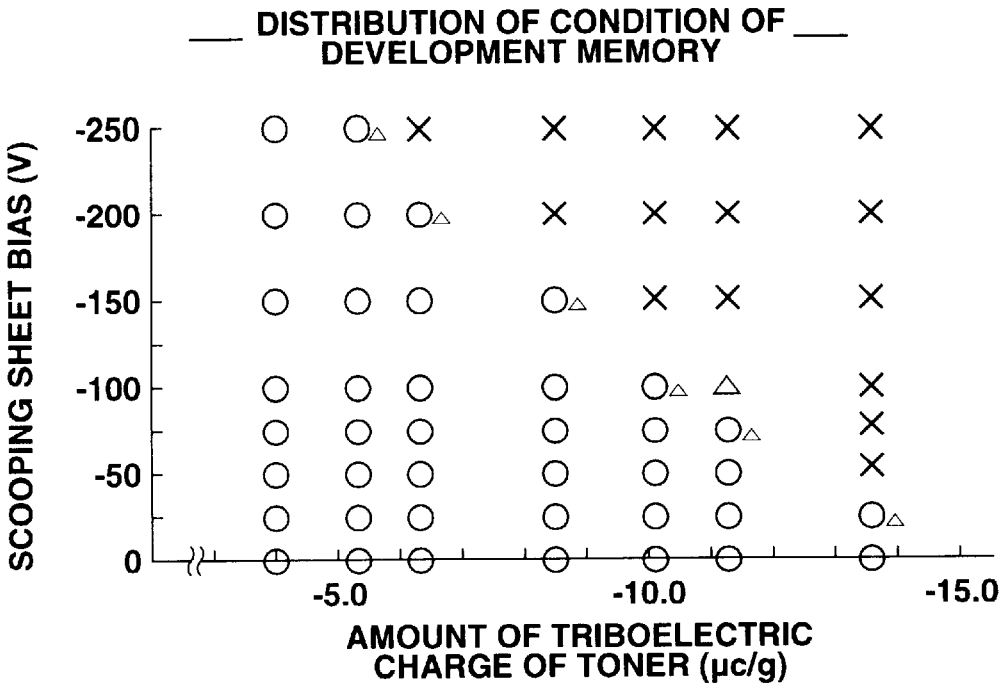
FIG. 4A is a graph showing a distribution of the condition of the development memory with the change of the amount of the triboelectric charge of the toner and the change of the conductive sheet (scooping sheet) bias, the distribution being obtained by the table in FIG. 3A.
Figure 4B:
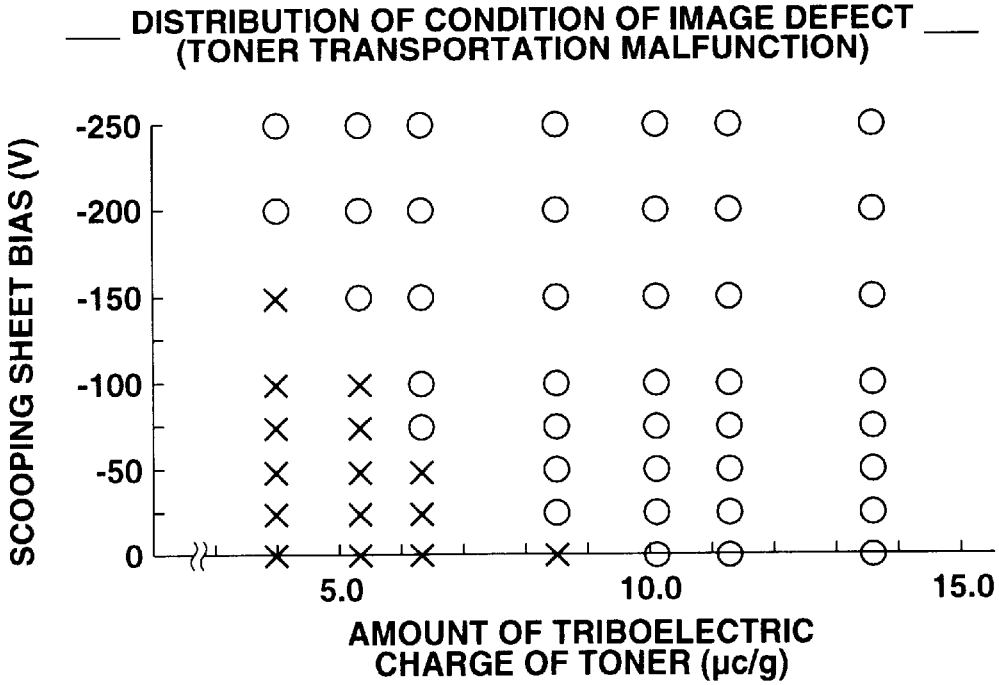
FIG. 4B is a graph showing a distribution of the condition of the image defect (the toner transportation malfunction) with the change of the amount of the triboelectric charge of the toner and the change of the conductive sheet (scooping sheet) bias, the distribution being obtained by the table in FIG. 3B.

FIG. 4A is a graph showing a distribution of the condition of the development memory, and FIG. 4B is a graph showing a distribution of the condition of the image defect (the toner transportation malfunction), both graphs being obtained by the tables of FIGS. 3A and 3B. In FIG. 4A, "X" and "Δ" marks are distributed in an upper right portion of the graph, and in FIG. 4B "X" marks are distributed in the lower left portion of the graph.

Figures 5, 6:
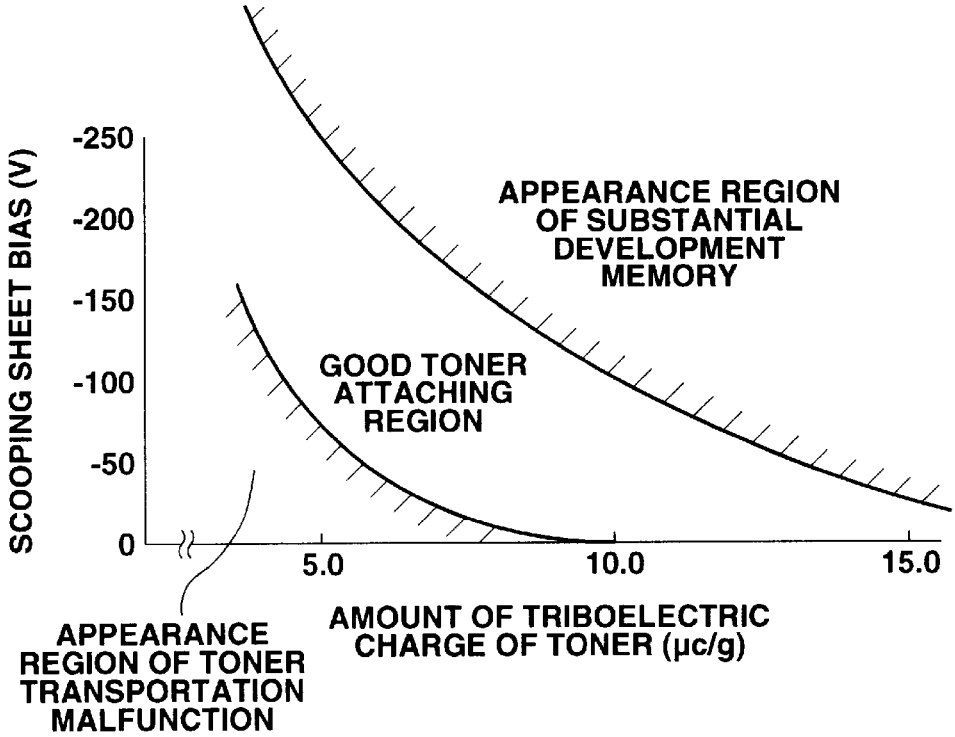
FIG. 5 is a graph showing a good toner attaching condition on a developing roller of the developing device with the change of the amount of the triboelectric charge of the toner and the change of the conductive sheet (scooping sheet) bias.
FIG. 6 is a table showing amounts of triboelectric charges of magenta, cyan, yellow and black toners, each having a particle size of 8.5 $\mu$m and prepared by using the same resin and the same antieletrostatic agent.

FIG. 5 is a graph showing a good toner attaching condition on the developing roller 45 of the developing device 44 with the change of the amount of the triboelectric charge of the toner and the change of the conductive sheet (scooping sheet) bias. As shown in FIG. 5, the good toner attaching condition in which the phenomon of the developing memory and the image defect (the toner transportation malfunction) will not occur is obliquely distributed from the upper left side to the lower right side. Therefore, if the sheet bias voltage to be applied to the developing-portion scooping sheet 66 is set depending upon the amount of the triboelectric charge of the toner 62 within the "good toner attaching condition region", good images can be always formed without the phenomenon of the development memory and the image defects.

Further, as previously described, when the image formation is repeated many times (when the image is printed on many sheets), the number of triboelectric charging of the toner increases, so that the characteristic of the toner deteriorates. In order to prevent the toner image guality from deteriorating which is caused by the decrease of the characteristic of the toner, a counter is provided to count the number of sheets used and the developing-portion scooping sheet bias voltage is gradually increased from an initial value with the increase of the number of sheets used.

Such a counter may be structured by setting the control device on the circuit substrates 58 to pick up the number of rotation of the pick-up roller 52, the stand-by roller pair 48, at least one of the photosensitive drums 38*a*, 38*b*, 38*c* or 38*d* or each of the photosensitive drums. The counter also may be structured by a contact sensor or a contactless sensor such as a photosensitive sensor provided in the guide path 49 or along the upper surface of the upper extending portion of the conveyor belt 35 in the upstream side of at least one of the photosensitive drums 38*a*, 38*b*, 38*c*, and 38*d* or each of the photosensitive drums in the moving direction of the upper extending portion.

Furthermore, although it is not shown in the attached any figures, if a positive sheet bias voltage is applied to the developing-portion scooping sheet 66, the image defect (the toner transportation malfunction) and the fogging phenomenon are generated even if a toner having the triboelectric charge as large as 13.6 $\mu$C/g is used.

Although the contact developing method is explained in this embodiment, the same results can be obtained by using a non-contact developing method in place of the contact developing method. Further, the elastic roller is employed as the developing roller in this embodiment the same results can be obtained by using a metal roller in place the elastic roller.

By the way, color images formed in one color image forming apparatus must be thermally fixed on a sheet by one fixing device. Therefore, the color toners to be used to form the color images must be covered with the same resin. Further, a color of a control agent used with the color toners to control the amount of the triboelectric charges of the toners must be transparent or white because it covers the color toners. Since the number of kinds of the transparent or white control agent is very small, the color toners must uses the same control agent. But, since the performance of the control agent is largely affected by kinds of pigments used in the color toners, the color toners with the same control agent will not have the same charge characteristics as to each other.

FIG. 6 shows amounts of triboelectric charges of magenta, cyan, yellow and black toners, each having a particle diameter of 8.5 $\mu$m and prepared by using the same resin and the same control agent, and the amounts being measured by the above describe method.

This means that if color images are formed under the same conductive sheet (scooping sheet) bias in the four image forming devices of one color image forming apparatus, the phenomenon of the development memory or the image defect (the toner transportation malfunction) is generated depending upon a color of toner.

In order to solve this problem raised from the combinations of the same control agent and the toners of the different colors, in the color image forming apparatus according to the embodiment of the present invention, the values of the conductive sheet (scooping sheet) bias applied to the scooping sheets 66 of the four developing devices 44 in one color image forming apparatus are varied on a basis of the colors of the toners to be used in the developing devices 44. To be more specific, the conductive sheet bias of −100V to −125V was applied to the scooping sheets 66 of the developing devices 44 using magenta and black toners, and the conductive sheet bias of 0 to −50V was applied to the scooping sheets 66 of the developing devices 44 using cyan and yellow toners. As a result of this, good color images were obtained without generating the phenomenon of the development memory and the image defects.

When the developing devices 44 were continuously used under the aforementioned conditions, the amount of the charge of each of the color toners decreases. When the amounts of the charges of the color toners were measured immediately before the color toners 62 were used up, the amount of the charge of magenta toner was 6.1 μC/g, that of the cyan toner was 9.6 μC/g, that of the yellow toner was 10.2 μC/g, and that of the black toner was 7.5 μC/g. However, the phenomenon of the development memory and the image defect were not observed. In contrast to this, the developing devices 44 were used in this condition but the conductive sheet (scooping sheet) bias voltage to be applied to the developing-portion scooping sheets 66 were set at 0V, the image defects were observed in the developing devices 44 using black and magenta toners.

As described above, even in the color image forming apparatus in which it is difficult to set the amounts of triboelectric charges of the color toners equal to each other, good images can be formed without the phenomenon of the development memory and the image defects by applying different conductive sheet (scooping sheet) bias voltages to the developing-portion scooping sheets 66 of the four developing devices 44, depending upon the amounts of the triboelectric charges of the color toners to be used in the developing devices 44.

As detailed above in detail, in the embodiment according to the present invention, the conductive scooping sheet 66 is used and a potential difference between the scooping sheet 66 and the developing roller 45 corresponding to the scooping sheet is generated depending upon the amount of the charge of the toner to be used with the developing roller, so that the attraction force of the toner to the developing roller 45 is weakened. It is therefore possible to easily rub off the residual toner from the developing roller. As a result, the amount of the toner attached on the circumferential surface of the developing roller 45 can be maintained at a predetermined constant level in every one rotation of the developing roller 45, and can always form a toner image on the developing roller without the phenomenon of the development memory and the fogging phenomenon.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A developing apparatus, comprising:

a developing hopper which (i) has an opening facing an image carrier on which an electrostatic latent image is formed, and (ii) stores a single-component nonmagnetic toner;

a developing roller which (i) is provided in the opening to expose a part of a circumferential surface of the developing roller, (ii) forms a developing portion between the exposed part of the circumferential surface and the image carrier, and (iii) carries the nonmagnetic single-component toner on the circumferential surface thereof to transport the single-component nonmagnetic toner to the developing portion from the hopper and to develop the electrostatic latent image on the image carrier at the developing portion;

a doctor blade which (i) contacts the circumferential surface of the developing roller on an upstream side of the developing portion in a rotational direction of the developing roller, and (ii) controls a thickness of the toner carried on the circumferential surface of the developing roller;

a toner feed roller which (i) is arranged in the developing hopper, and (ii) presses on the developing roller on an upstream side of the doctor blade in the rotational direction of the developing roller to feed the toner in the hopper to the circumferential surface of the developing roller;

a conductive sheet member which (i) contacts the circumferential surface of the developing roller on a downstream side of the developing portion and on an upstream side of the toner feed roller in the rotational direction, (ii) permits a residual toner not used to develop the electrostatic latent image on the image carrier at the developing portion and left on the developing roller to pass into the developing hopper, and (iii) prevents the toner in the developing hopper from leaking out along the circumferential surface of the developing roller on the downstream side of the developing portion and on the upstream side of the toner feed roller in the opening;

a developing bias voltage applying device which applies a developing bias voltage to the developing roller, said developing bias voltage having a same polarity as that of a charge characteristic of the toner;

a doctor bias voltage applying device which applies a doctor bias voltage to the doctor blade, said doctor bias voltage being larger than the developing bias voltage in the absolute value and having the same polarity as that of the charge characteristic of the toner;

a feed bias voltage applying device which applies a feed bias voltage to the toner feed roller, said feed bias voltage being larger than the developing bias voltage in absolute value and having the same polarity as that of the charge characteristic of the toner; and a conductive sheet bias voltage applying device which applies a sheet bias voltage, ranging from 0V to the developing bias voltage, to the conductive sheet member to generate a potential difference between the conductive sheet member and the developing roller, thereby weakening an attachment of the residual toner to the developing roller.

2. A developing device according to claim 1, wherein the conductive sheet bias device sets a value of the sheet bias voltage applied to the conductive sheet member based on an amount of a charge of the toner.

3. A developing device according to claim 2, wherein the value of the sheet bias voltage is set in such a manner that the larger the amount of the charge of the toner, the larger the difference between the sheet bias voltage and the developing bias voltage, and the smaller the amount of the charge of the toner, the smaller the difference between the sheet bias voltage and the developing bias voltage.

4. A developing device according to claim 1, further comprising:

a detector which detects a number of image formations on the image carrier; and a sheet bias voltage controller which varies the sheet bias voltage applied to the conductive sheet member to make the sheet bias voltage closer to the developing bias voltage in response to an increase of the number of image formations on the image carrier detected by the detector.

5. A developing device according to claim 1, further comprising means for pressing the developing roller on the image carrier to form the developing portion therebetween.

6. An image forming unit removably attached to an image forming apparatus, said image forming apparatus being provided with (i) a developing bias voltage applying device which can apply a developing bias voltage having a same polarity as that of a charge characteristic of a toner, (ii) a doctor bias voltage applying device which can apply a doctor bias voltage larger than the developing bias voltage in absolute value and having the same polarity as that of the charge characteristic of the toner, (iii) a feed bias voltage applying device which can apply a feed bias voltage larger than the developing bias voltage in absolute value and having the same polarity as that of the charge characteristic of the toner, and (iv) a conductive sheet member bias voltage applying device which can apply a sheet bias voltage ranging from 0V to the developing bias voltage in absolute value and having the same polarity as that of the charge characteristic of the toner, said image forming unit comprising:

a developing hopper which (i) has an opening facing an image carrier on which an electrostatic latent image is formed, and (ii) stores a single-component nonmagnetic toner;

a developing roller which (i) is provided in the opening to expose a part of a circumferential surface of the developing roller, (ii) forms a developing portion between the exposed part of the circumferential surface and the image carrier, and (iii) carries the nonmagnetic single-component toner on the circumferential surface thereof to transport the single-component nonmagnetic toner to the developing portion from the hopper and to develop the electrostatic latent image on the image carrier at the developing portion;

a doctor blade which (i) contacts the circumferential surface of the developing roller on an upstream side of the developing portion in a rotational direction of the developing roller, and (ii) controls a thickness of the toner carried on the circumferential surface of the developing roller;

a toner feed roller which (i) is arranged in the developing hopper, and (ii) presses on the developing roller on an upstream side of the doctor blade in the rotational direction of the developing roller to feed the toner in the hopper to the circumferential surface of the developing roller; and a conductive sheet member which (i) contacts the circumferential surface of the developing roller on a downstream side of the developing portion and on an upstream side of the toner feed roller in the rotational direction, (ii) permits a residual toner not used to develop the electrostatic latent image on the image carrier at the developing portion and left on the developing roller to pass into the developing hopper, and (iii) prevents the toner in the developing hopper from leaking out along the circumferential surface of the developing roller on the downstream side of the developing portion and on the upstream side of the toner feed roller in the opening;

wherein, when the image forming unit is attached to the image forming apparatus when the image forming unit is attached to the image forming apparatus, the developing roller, the doctor blade, the toner feed roller, and the conductive sheet member of the image forming unit are electrically connected to the developing bias voltage applying device, the doctor bias voltage applying device, the feed bias voltage applying device, and the conductive sheet bias voltage applying device of the image forming apparatus, respectively, and the sheet bias voltage generates a potential difference between the conductive sheet member and the developing roller, thereby weakening an attachment of the residual toner to the developing roller.

7. An image forming unit according to claim 6, wherein the image forming unit includes an image carrier subunit having the image carrier, and a developing subunit which is united with the image carrier subunit and which is removably attached to the image forming unit.

8. An image forming unit according to claim 7, further comprising means for dressing the developing roller on the image carrier to form the developing portion therebetween.

9. A color forming image having a plurality of developing devices, each of the developing devices comprising:

a developing hopper which (i) has an opening facing an image carrier on which an electrostatic latent image is formed, and (ii) stores a single-component nonmagnetic toner;

a developing roller which (i) is provided in the opening to expose a part of a circumferential surface of the developing roller, (ii) forms a developing portion between the exposed part of the circumferential surface and the image carrier, and (iii) carries the nonmagnetic single-component toner on the circumferential surface thereof to transport the single-component nonmagnetic toner to the developing portion from the hopper and to develop the electrostatic latent image on the image carrier at the developing portion;

a doctor blade which (i) contacts the circumferential surface of the developing roller on an upstream side of the developing portion in a rotational direction of the developing roller, and (ii) controls a thickness of the toner carried on the circumferential surface of the developing roller;

a toner feed roller which (i) is arranged in the developing hopper, and (ii) presses on the developing roller on an upstream side of the doctor blade in the rotational direction of the developing roller to feed the toner in the hopper to the circumferential surface of the developing roller;

a conductive sheet member which (i) contacts the circumferential surface of the developing roller on a downstream side of the developing portion and on an upstream side of the toner feed roller in the rotational direction, (ii) permits a residual toner not used to develop the electrostatic latent image on the image carrier at the developing portion and left on the developing roller to pass into the developing hopper, and (iii) prevents the toner in the developing hopper from leaking out along the circumferential surface of the developing roller on the downstream side of the developing portion and on the upstream side of the toner feed roller in the opening;

a developing bias voltage applying device which applies a developing bias voltage to the developing roller, said developing bias voltage having the same polarity as that of a charge characteristic of the toner;

a doctor bias voltage applying device which applies a doctor bias voltage to the doctor blade, said doctor bias voltage being larger than the developing bias voltage in absolute value and having the same polarity as that of the charge characteristic of the toner;

a feed bias voltage applying device which applies a feed bias voltage to the toner feed roller, said feed bias voltage being larger than the developing bias voltage in absolute value and having the same polarity as that of the charge characteristic of the toner; and a conductive sheet bias voltage applying device which applies a sheet bias voltage, ranging from 0V to the developing bias voltage, to the conductive sheet member to generate a potential difference between the conductive sheet member and the developing roller, thereby weakening an attachment of the residual toner to the developing roller, wherein the conductive sheet bias voltage applying device sets a value of the sheet bias voltage applied to the conductive sheet member based on an amount of a charge of the toner.

* * * * *